US005637182A

United States Patent [19]

Kimura et al.

[11] Patent Number: 5,637,182

[45] Date of Patent: Jun. 10, 1997

[54] APPARATUS AND METHOD FOR ATTACHING TAGS ON ARTICLES

[75] Inventors: Tetsuro Kimura, Kurihashi-machi; Hideyuki Maezawa, Satte, both of Japan

[73] Assignee: Lintec Corporation, Tokyo, Japan

[21] Appl. No.: 460,544

[22] Filed: Jun. 2, 1995

[30] Foreign Application Priority Data

Jul. 21, 1994 [JP] Japan ..... 6-169578
May 26, 1995 [JP] Japan ..... 7-127986

[51] Int. Cl.[6] ..... B44C 1/18; B65H 5/02

[52] U.S. Cl. ..... 156/542; 156/DIG. 28; 271/272

[58] Field of Search ..... 156/542, DIG. 28; 271/272

[56] References Cited

U.S. PATENT DOCUMENTS

| | | | |
|---|---|---|---|
| 4,321,103 | 3/1982 | Lindstrom et al. | 156/351 |
| 4,847,130 | 7/1989 | Cooper | 428/41.8 |
| 5,104,105 | 4/1992 | Cote et al. | 270/1.02 |

FOREIGN PATENT DOCUMENTS

| | | |
|---|---|---|
| 0306125 | 3/1989 | European Pat. Off. . |
| 2447859 | 8/1980 | France . |
| 2008187 | 9/1971 | Germany . |
| 2217032 | 10/1973 | Germany . |
| 8226282.9 | 5/1990 | Germany . |
| 389471 | 6/1991 | Japan . |

*Primary Examiner*—Robert J. Warden
*Assistant Examiner*—E. Leigh Dawson
*Attorney, Agent, or Firm*—Webb Ziesenheim Bruening Logsdon Orkin & Hanson, P.C.

[57] ABSTRACT

An apparatus for attaching a tag on a neck portion of an article is disclosed. The apparatus includes an article-carrying member, a tag-supplying device, and a tag-carrying device disposed beyond the article-carrying member along a carrying direction of the article. The tag-carrying device includes two pairs of paired traveling belts disposed right and left of the tag and inclined so that each of the belts has a starting portion higher than the article and an ending portion of approximately the same height as a shoulder of the article. The tag-carrying device is adapted for carrying a tag synchronously with the carried article while holding both side edges of the tag between the upper and lower traveling belts to thereby insert a head of the article into a tag aperture and attach the tag to the neck portion of the article.

5 Claims, 5 Drawing Sheets

APPARATUS AND METHOD FOR ATTACHING TAGS ON ARTICLES

FIELD OF THE INVENTION

The present invention relates to an apparatus capable of automatically attaching at a neck of an article a tag on which, for example, the contents of commemorative campaign are described, in such a manner that said tag is not directly pasted to the peripheral surface of the article but attached to the neck thereof. The present invention also relates to a method of attaching such a tag to a neck of an article.

BACKGROUND OF THE INVENTION

Containers, or similar articles such as PET bottles and bottles of other materials, are often displayed and sold with tags attached to their necks. The contents of the tag may include, for example, description of occasionally conducted campaigns.

In the prior art, the generally known tag attaching apparatus capable of automatically attaching the tag of the above kind on a neck of an article (such as containers) comprises a labeler which continuously delivers a strip supporting the tag on the surface thereof. Disposed above a conveyor along which a plurality of necked articles are traveling, the labeler sharply folds back the strip in such a manner that the tag separate from the surface supporting the tag. As the tag is peeled from the strip, it falls downward, causing it to be fitted at the neck of the article. This apparatus is described in, for example, Japanese Utility Model Laid-Open Publication No. 3(1991)-89471.

The above tag has an aperture through which a head portion of the article is passed. The diameter of the aperture is made slightly larger than the maximum outside diameter of the head portion of the article, so that the head portion of the article is readily passed through the aperture.

When the article is, for example, a PET bottle having a flanged neck portion, the technique is known in which the tag is caused to fall to rest on the flange in the same manner as mentioned above. Further air is blown downward to force the tag to move below the flange until reaching a shoulder portion of the article.

In this technique, the diameter of the aperture provided in the tag is rendered slightly smaller than the outside diameter of the flange, and the tag is provided with slits radially extending from the aperture. The diameter of the aperture is easily enlarged by virtue of the slits, so that the flange of the bottle can pass through the aperture.

The above conventional attaching of a tag to an article has a drawback, however, in that the tag readily falls off the neck of the article due to the enlarged aperture. This happens, for example, when the article is turned over in error during the transportation thereof.

Further, with respect to the above conventional attaching of the tag by forcing it below the flang with blowing air, the current situation has a drawback because uniform blowing of the air is difficult. Additionally, the downward fall of the tag involves a dispersion, causing the center of the aperture to become misaligned with the center of the head portion of the container. Another drawback is that the tag suffers from an irregular slope, thereby causing the blowing air in the above conditions to lead to breakage of the tag and lack of certainty.

OBJECT OF THE INVENTION

Under the above circumstances, the object of the present invention is to provide an apparatus and a method for automatically and securely attaching tags at a neck portion of an article (hung around the neck) such as a container in a manner such that it does not readily fall out.

SUMMARY OF THE INVENTION

For attaining the above object, the present invention provides an apparatus capable of attaching a tag at a neck portion of an article, which comprises:

an article-carrying means for carrying an article having a head portion in a predetermined direction;

a tag-supplying means for supplying a tag having an aperture adapted for inserting thereinto said head portion of the article;

a tag-carrying means disposed beyond the article-carrying means along carrying the direction of the article, comprising two paired upper and lower traveling belts, said pairs of the upper and lower belts being laterally disposed respectively right and left of the tag and inclined so that each of the belts has a starting portion higher than the article and an ending portion of approximately the same height as a shoulder of the article, said tag-carrying means adapted for carrying the tag synchronously with the carried article while holding the side edges of the tag between the upper and lower traveling belts to thereby insert the head portion of the article into the aperture and attach the tag at the neck portion of the article.

In the apparatus capable of attaching a tag according to the present invention, the tag supplying means comprises:

a strip-supplying means for continuously supplying a strip which has a support surface supporting the tag;

a take-up means for taking up the strip having been supplied; and a peel plate disposed between the strip supplying means and the take up means, and adapted for sharply folding back the strip with a front edge portion thereof in such a manner that the tag separate from the support surface.

In the apparatus capable of attaching a tag according to the present invention, the tag-carrying means may be provided with a regulating means for regulating the lateral spacings between the paired traveling belts disposed right and left of the tag-carrying means, respectively.

Further, the present invention further provides a method which comprises:

carrying an article having a head portion in a predetermined direction; and carrying a tag, having an aperture adapted for inserting thereinto the head portion of the article by two paired upper and lower traveling belts while holding the side edges of the tag between the paired upper and lower belts, said paired upper and lower belts moving synchronously with the carried article so the center of the aperture coincides with the center of the head portion of the article, and being inclined so that each of them has a starting portion higher than the article and an ending portion of approximately the same height as a shoulder of the article to thereby guide the tag from a position beyond the article to the vicinity of the shoulder portion of the article while inserting the head portion of the article into the aperture of the tag.

In the method for attaching a tag at a neck portion of an article, said tag may be supplied to said pairs of the upper and lower belts by continuously carrying a strip having a surface supporting which on the tag is supported; and sharply folding back the strip in such a manner that the tag seperates from the supporting surface.

By virtue of the present invention of the above constitution, the tag upon being peeled from the strip is carried, without undergoing free fall, synchronously with the carriage of the article by two pairs of the upper and lower traveling belts in the state of having each of its side edges held between the paired upper and lower traveling belts extending along the carrying direction of the article, so that the tag is gradually guided downward. This descent causes the head portion of the article to be gradually inserted in the aperture of the tag to the extent that the tag is forcibly guided to the vicinity of the shoulder portion of the article. Even if the neck portion of the article is flanged, the descent forces the aperture to enlarge by means of the slits, so that the flange portion passes through the aperture. Thus, the tag can securely be fitted at the neck portion of the article.

Further, in the present invention, a folding force in conformity with the size of the tag can be exerted by providing the above regulating means for regulating the lateral spacings between the two paired traveling belts disposed right and left, respectively, of the tag.

EMBODIMENT OF THE INVENTION

Figure 1:
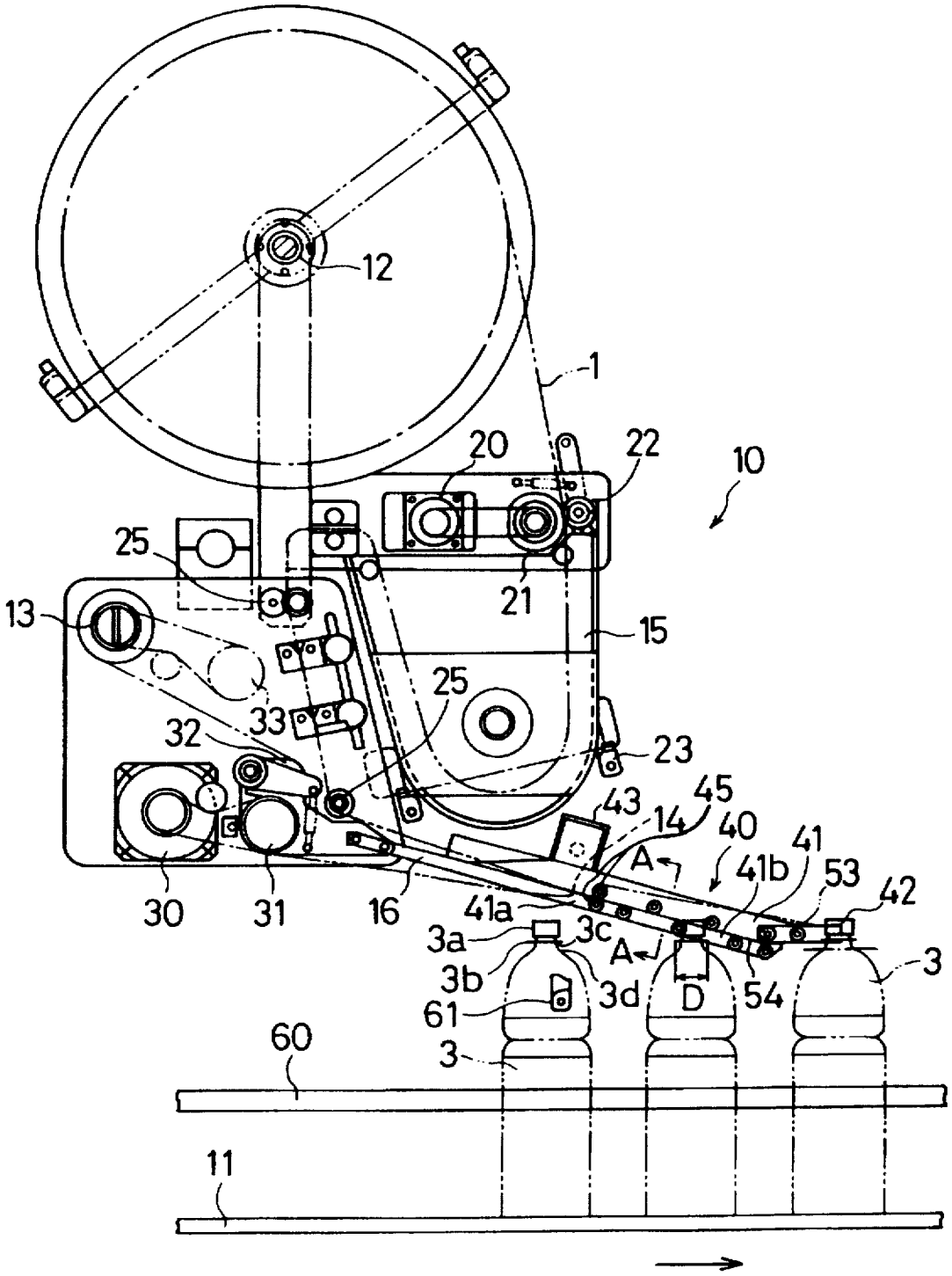
FIG. 1 shows a side view of an embodiment of the apparatus according to the present invention.

A preferred embodiment of the present invention will be described below referring to the drawings.

Figure 2:
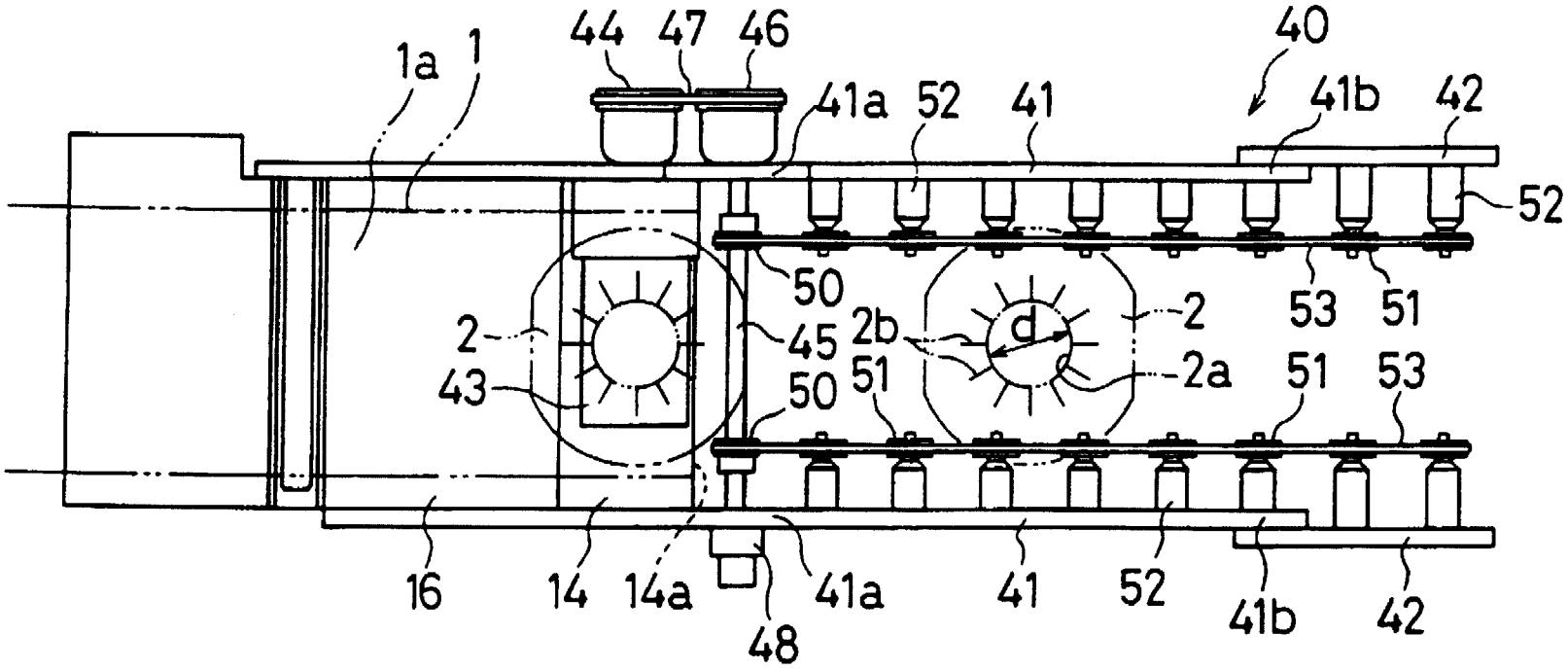
FIG. 2 shows a plan view of the embodiment of the tag carrying device suitable for use in the present invention.
Figure 3:
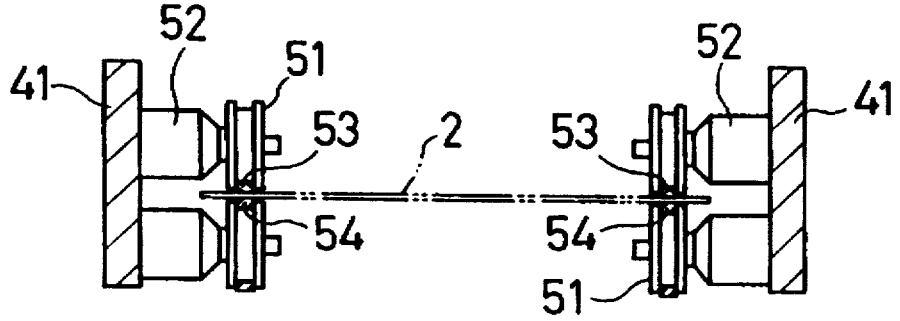
FIG. 3 shows a sectional view on the line A—A of FIG. 1.

FIGS. 1 to 3 illustrate a preferred embodiment of the present invention in which tags 2 held on a strip 1 at given pitches are peeled one by one and automatically attached at a neck portion 3c of a container 3 such as a PET bottle.

The tag 2 is detachably bonded (held or supported) to the surface 1a of the strip 1. The tag 2 is provided with an aperture (hole) 2a and a plurality of slits 2b radially extending from the aperture 2a. The diameter of the aperture 2a is enlarged by means of the slits 2b, that is, by readily effected vertical bending of parts each interposed between neighboring slits 2b.

The diameter d of the aperture 2a is rendered equal to or greater than the upper outside diameter of a head portion 3a of a container 3 but rendered slightly smaller than the outside diameter D of a flange portion 3b disposed at the neck portion 3c ($d<D$).

Thus, when the diameter of the aperture 2a is enlarged to thereby allow the flange portion 3b of the container to pass therethrough as mentioned above and when the aperture 2a is restored to the original state by the elasticity of the tag, the aperture 2a catches on the flange portion 3b so that ready removal of the tag is prevented.

In this embodiment, the apparatus is provided with a labeler 10 capable of peeling the tags 2 from the strip 1 one by one and sequentially feeding the peeled tags 2 onto the containers 3. The apparatus is further provided with a carrying conveyor 11 positioned below the labeler 10 and capable of continuously carrying the containers 3 in the state of standing up.

The labeler 10 is provided with an unwinding shaft 12 and a winding shaft 13. A carrying path for the strip 1 is formed between the unwinding shaft 12 and the winding shaft 13. A peel plate 14 is adapted to sharply fold back the strip 1 so that the tag-supporting surface 1a separates from the tag 2. Thus, the tag 2 is pealed from the strip 1.

Specifically, the strip 1 is once guided from the upward arranged unwinding shaft 12 to a downward arranged 10 slack zone 15 where the strip 1 is bent into the shape of character U. Then, the strip 1 is guided downward and passes a free end (front edge portion) 14a of the peel plate 14, and thereafter is carried backward opposite to the carrying direction of the container 3 to be finally wound by the winding shaft 13.

A strip supply roll 21 adapted to rotate in accordance with the rotation of a strip supply motor 20 and a pinch roll 22 adapted to hold the strip 1 between itself and the strip supply roll 21 are disposed opposite to each other between the unwinding shaft 12 and the slack zone 15. A slack-level detecting switch 23 capable of detecting the level of slack of the strip 1 within the slack zone 15 is disposed in the slack zone 15. The apparatus is so set that when the detecting switch 23 no longer detects the strip 1, the strip supply motor 20 is driven to sequentially deliver the strip 1 into the slack zone 15.

The strip 1 is guided to the front edge portion 14a of the peel plate 14 by a plurality of guide rolls 25 disposed along the carrying path thereof. At the front edge portion 14a the strip 1 is folded back about 180°, separating the tag 2 from the supporting surface 1a. That is, the peel plate 14 is flat, fixed to the tip of a peel plate pedestal 16, arranged in a slightly downward direction along the carrying direction of the container 3, and has a front edge portion 14a (a reel end) formed so as to have an acute angle.

Thus, the strip 1 is folded back along the peel plate 14 about 180° so that the supporting surface 1a separates from the tag 2. At this time, the tag 2 continues to linearly travel along the upper surface of the peel plate 14 due to the rigidity of the tag 2. As a result, the tag 2 overcomes the adhesion between the tag 2 and the strip 1 and is peeled from the strip 1.

The resultant strip 1 from which the tag 2 has been peeled is guided between a drive roll 31 adapted to rotate in accordance with the drive of a strip carrying motor 30 and a pinch roll 32 disposed opposite to the drive roll 31. Then, the strip 1 is wound round the winding roll 13 adapted to rotate in accordance with the drive of a strip winding motor 33.

In the apparatus, the drive of the strip carrying motor 30 is controlled so as to regulate the carrying speed and quantity of the strip 1 and in turn the carrying speed and numbers of the tag 2.

A tag carrying device 40 adapted to sequentially carry the tags 2 peeled by means of the peel plate 14 to the head portions 3a of the respective containers 3 is disposed adjacent peel plate 14.

The tag carrying device 40 is provided with a pair of sloped frames 41, 41 respectively disposed right and left at a given lateral spacing, which have base ends 41a, 41a fixed to both side ends of the peel plate pedestal 16 and which extend downwardly, inclined along the lengthwise direction of the peel plate pedestal 16, i.e., along carrying the direction of the container 3. An extending horizontal frame 42 is connected to the other end 41*b*, 41*b* of each of the sloped frames 41, 41.

The above-mentioned horizontal frame 42 is provided for preventing the lifting of the tag 2. For example, when a part of the neck portion 3*c* below the flange 3*b* of the container 3 is long, the horizontal frame 42 may be sloped slightly downward along the carrying direction to thereby guide the tag 2 more deeply to the shoulder portion 3*d* of the container 3.

A belt driving motor 43 is disposed above the sloped frames 41, 41, and a driving pulley 44 is fastened to an output shaft of the belt driving motor 43. Upper and lower driving shafts 45 arranged adjacent to the front edge portion 14*a* of the peel plate 14 are rotatably supported by the sloped frames 41, 41. A timing belt 47 is stretched between a driven pulley 46 fastened to one end of the upper driving shaft 45 and the driving pulley 44.

A gear 48 is fastened to the other end of the upper driving shaft 45, and a gear (not shown) which interlocks and has the same size as the above-mentioned gear 48 is fastened to the corresponding end of the lower driving shaft 45.

Driving pulleys 50 (four in total), positioned inside the sloped frames 41, 41, are respectively fastened to the longitudinal ends of the driving shafts 45. A plurality of pulleys 51, arranged in two rows on the upper and lower sides of each sloped frame 41 and in one row with respect to each horizontal frame 42, are rotatably supported at given intervals. The pulleys 51 are disposed on the tips of supports 52 fastened inside the frames 41, 42.

With respect to the frames 41, 42 on each side, an upper traveling belt 53 is stretched round the driving pulley 50 fastened to the upper driving shaft 45, the upper pulleys 51 inside the sloped frame 41 and the pulleys 51 inside the horizontal frame 42. Also, with respect to the frames 41 on each side, a lower traveling belt 54 is stretched round the driving pulley 50 fastened to the lower driving shaft 45 and the lower pulleys 51 inside the sloped frame 41.

Thus, the four traveling belts 53, 54 synchronously travel toward the same direction between the upper and lower pulleys 51, 51. The upper traveling belt 53 and the corresponding lower traveling belt 54 hold both side edges of the tag 2 peeled with the peel plate 14. The traveling belts 53, 54 carry the tag 2 in accordance with the travel of the traveling belts 53, 54.

The lower end of the tag carrying device 40 is positioned in the vicinity of the shoulder portion 3*d* of the container 3 carried on the carrying conveyor 11, i.e., below the flange 3*b* of the neck portion 3*c* of the container 3.

A guide member 60 is fixed above the carrying conveyor 11. The guide member 60 lines up the containers 3. Also, a container detecting switch 61, capable of detecting the arrival of the container 3 carried on the carrying conveyor 11 at a given point, is provided above the carrying conveyor 11.

The functions achieved in the above embodiment will now be described.

The tags 2 held on the strip 1 and sequentially supplied are peeled with the peel plate 14 of the labeler 10 by delivering the strip 1. The peeled tags 2 are held at both side edges thereof between the respective pairs of upper and lower traveling belts 53, 54 arranged right and left of the tag carrying device 40 and carried in accordance with the travel of the traveling belts 53, 54.

The apparatus is so set that the carrying speed of the tag 2 by means of the traveling belts 53, 54 agrees with that of the container 3 by means of the carrying conveyor 11. The delivery of the strip 1 is timed in accordance with the detection of the container 3 by means of the container detecting switch 61.

That is, the apparatus is so adjusted that the strip carrying motor 30 is driven with a given timing after the detection of the passage of the container 3 by means of the container detecting switch 61 to thereby make the center of the container 3 to agree with (coincide with) the center of the aperture 2*a* of the peeled tag 2.

The tag 2 is gradually guided downward in accordance with the travel of the traveling belts 53, 54, so that the head portion 3*a* of the container 3 is gradually inserted in the aperture 2*a*. Since the tag 2 is guided to the vicinity of the shoulder portion 3*d* of the container 3, the tag 2 is forcibly pressed during this guidance to thereby pass the flange 3*b* of the container 3.

This operation can be easily and securely performed because the diameter of the aperture 2*a* is enlarged by means of the slits 2*b* and because the tag 2 is tensioned due to the holding thereof in the state of having its side edges held between the traveling belts 53, 54. The right and left arranged pairs of the upper and lower traveling belts 53, 54 are positioned on both sides along the carrying direction of the container 3 so that they do not hinder the carrying of the container 3.

The containers 3 each attached with the tag 2 as described above are sequentially output to the next step to thereby finalize the operation of attaching the tag.

Although the traveling belts 53, 54 are continually traveled in order to attach the tag 2 in the above embodiment, they may be intermittently traveled in conformity with the drive of the strip carrying motor 30.

The purpose of providing the horizontal frame 42, attaching the pulley 51 and stretching the upper traveling belt 53 is to prevent the lifting of the tag 2. When this is not needed, the horizontal frame 42 and the pulley 51 can be omitted.

Figure 4:
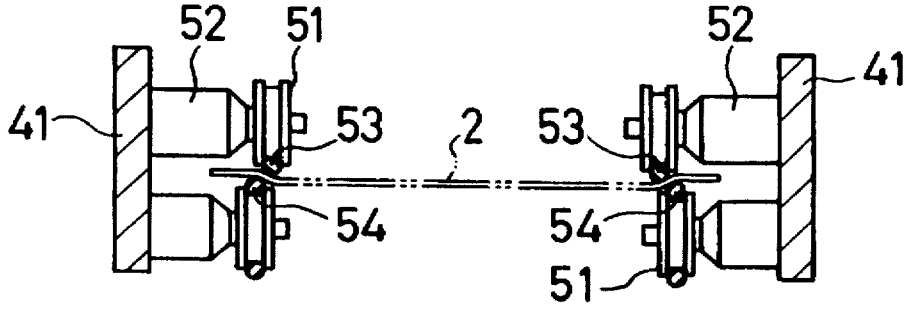
FIG. 4 shows a view corresponding to FIG. 3 of another embodiment of the tag carrying device suitable for use in the present invention.

Although flat belts are employed as the upper and lower traveling belts 53, 54 in the above embodiment, naturally, use may be made of V and round belts. When round belts are employed, each of the round-belt-made upper traveling belts 53 may be positioned inside the corresponding round-belt-made lower traveling belt 54 and slightly downward as shown in FIG. 4 to thereby enlarge the contacting area between the traveling belts 53, 54 and the tag 2 in order to prevent the tag 2 from dislocation and increase the tension capable of giving to the tag 2.

Figure 5:
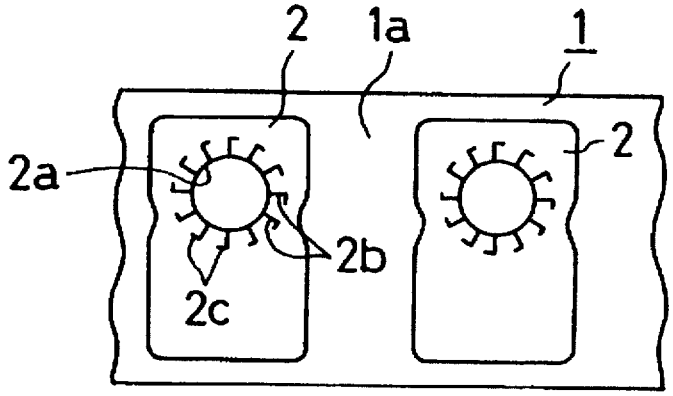
FIG. 5 shows a plan view of another embodiment of the tag.

The enlargement of the diameter of the aperture 2*a* can be facilitated by employing a tag 2 in which notches 2*c* linearly extending in series at the respective tips of slits 2*b* radially extending from the aperture 2*a* are arranged in the circumferential direction, as shown in FIG. 5.

The present invention is naturally applicable to variously shaped tags not shown, such as those having a rectangular aperture whose short side has a length smaller than the diameter of the flange portion of the container and having a circular aperture which has a diameter greater than the diameter of the flange portion of the container and has the inner circumferential portion provided with an inward projecting tongue piece.

Figure 6:
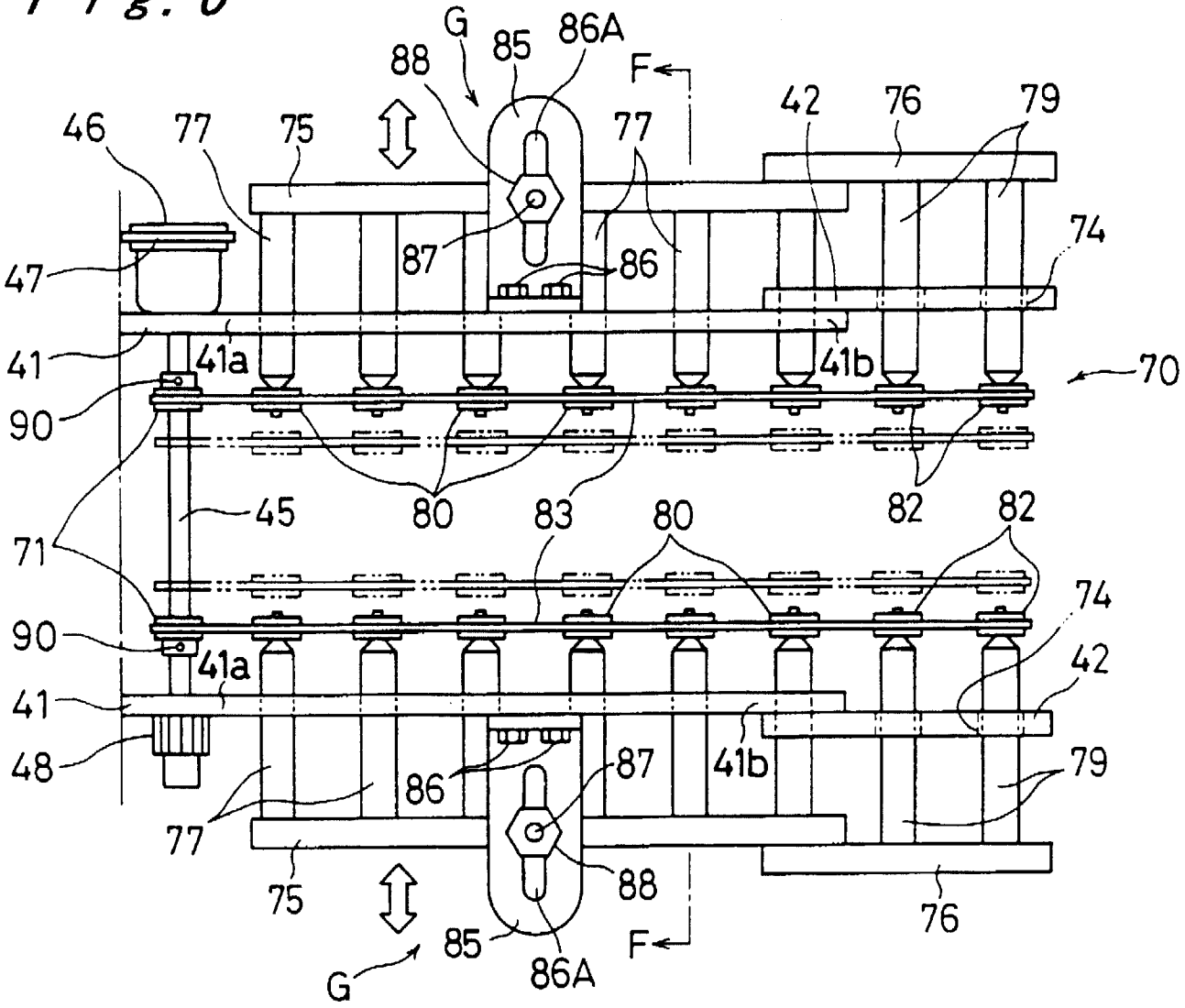
FIG. 6 shows a plan view of a further form of structure of the tag carrying device.
Figure 7:
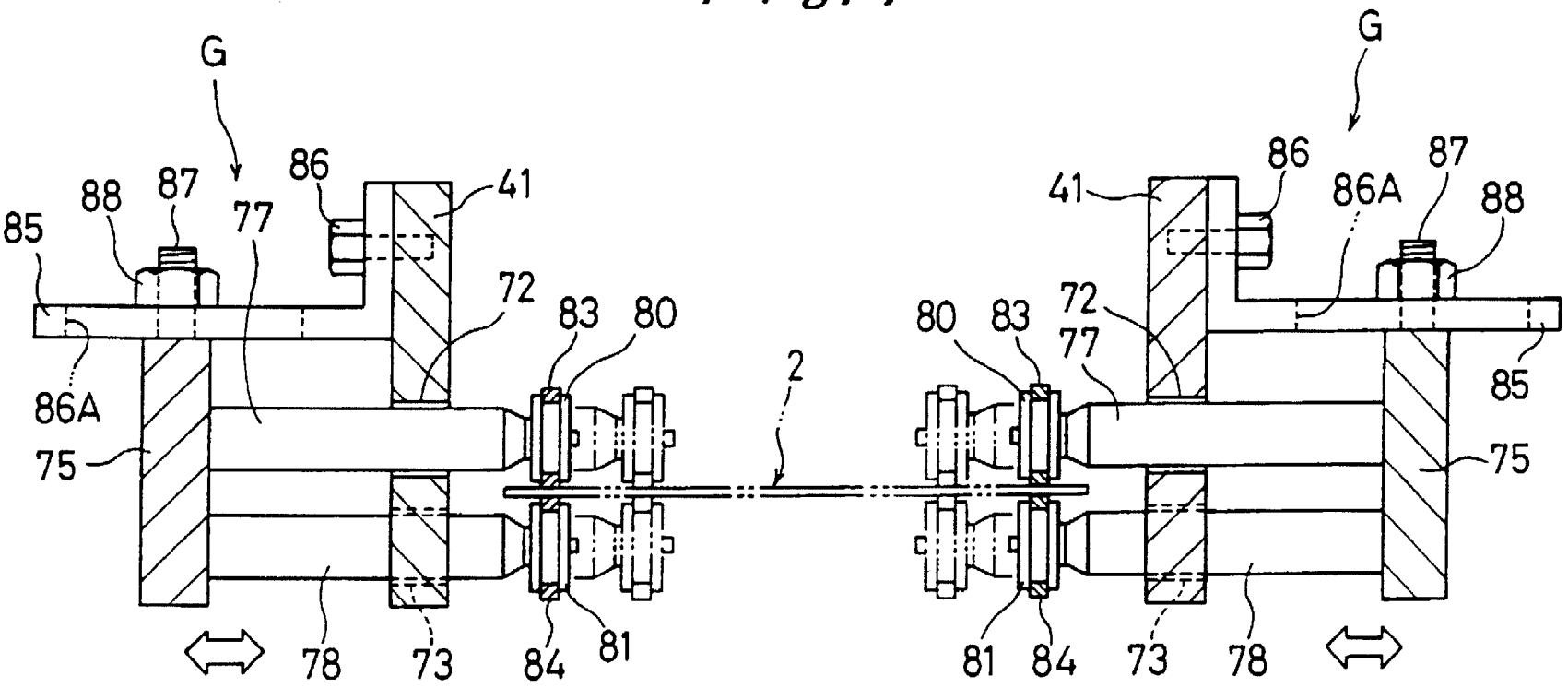
FIG. 7 shows a view of a right-side section on the line F—F of FIG. 6.

Another preferred embodiment of the present invention will be described below referring to FIGS. 6 and 7. FIG. 6 shows a plan view of the another preferred embodiment of the tag carrying device 70, and FIG. 7 shows a view of a right-side section on the line F—F of FIG. 6. In FIGS. 6 and 7, the same parts or portions are denoted by the same numerals as in FIGS. 1 and 2.

In this embodiment, each of a vertically arranged pair of driving shafts 45 is provided with a pair of driving pulleys 71. The paired driving shafts 45 have semi-annular cross sections, and the driving pulleys 71 are freely movable along the axis of the driving shaft 45. The driving pulleys 71 are fixed at predetermined portions by turning setscrews 90. The cross section configuration of each of the paired driving shafts 45 may also be square or a spline or channeled form.

Each of the sloped frames 41 is provided with two rows of shaft holes horizontally extending from the inner surface to the outer surface thereof, i.e., upper shaft holes 72 and lower shaft holes 73. Each of the horizontal frames 42 is provided with a row of shaft holes 74 of the same height. Each of the upper shaft holes 72 and lower shaft holes 73 provided in one of the sloped frames 41 is paired with the upper shaft holes 72 and lower shaft holes 73 provided in the other sloped frame 41 so that the upper or lower shaft holes in the pair have the same center axis. Further, each of the shaft holes 74 provided in one of the horizontal frames 42 is paired with the shaft holes 74 provided in the other horizontal frame 42 so that the shaft holes in the pair have the same center axis.

First side plates 75 with the same slopes as those of the sloped frames 41 and parallel to the sloped frames 41 are disposed outside the sloped frames 41. On the other hand, horizontal second side plates 76 parallel to the horizontal frames 42 are disposed outside the horizontal frames 42. One end of the first side plate 75 and one end of the adjacent second side plate 76 are fastened to each other. Cylindrical upper supports 77 and lower supports 78 protrudent toward the sloped frames 41 are fastened to the first side plates 75. On the other hand, cylindrical supports 79 protrudent toward the horizontal frames 42 are fastened to the second side plates 76.

The positions of the upper supports 77 correspond to the upper shaft holes 72, while the positions of the lower supports 78 correspond to the lower shaft holes 73. On the other hand, the positions of the supports 79 correspond to the shaft holes 74. The upper supports 77 and lower supports 78 are inserted in the upper shaft holes 72 and lower shaft holes 73, respectively, in a manner such that the supports 77, 78 are freely movable along their longitudinal directions through the holes 72, 73. On the other hand, the supports 79 are inserted in the shaft holes 74 in a manner such that the supports 79 are freely movable along their longitudinal directions through the holes 74.

An upper pulley 80 is fitted on the tip of each of the upper supports 77, while a lower pulley 81 is fitted on the tip of each of the lower supports 78. On the other hand, a pulley 82 is fitted on the tip of each of the supports 79. On each side, an upper traveling belt 83 is stretched round the upper driving pulley 71, upper pulleys 80 and pulleys 82, while a lower traveling belt 84 is stretched round the lower driving pulley 71 and lower pulleys 81.

Further, an outside protrudent guide plate 85 is fastened by means of screws 86 to each of the sloped frames 41. Each guide plate 85 is provided with a long hole 86A parallel to the driving shaft 45. An upward protrudent stud 87 is fitted on the upper surface of the first side plate 75. The stud 87 is inserted in the long hole 86A in a manner such that the stud 87 is freely movable along the longitudinal direction of the long hole 86A.

The tip of the stud 87 passes through the long hole 86A to come above the guide plate 85, and the tip is fitted with a nut 88. The above first side plates 75, second side plates 76, guide plates 85, studs 87 and nuts 88 constitute regulating means G. The other elements are the same as in FIGS. 1 to 3.

In this embodiment, the rotation of the driving shafts 45 is conveyed to the driving pulleys 71, upper traveling belts 83 and lower traveling belts 84 to cause them to run, and the tags 2 are carried by the same action as in the embodiment of FIGS. 1 to 3 to be finally attached to the neck portions of the containers. Therefore, the same effects as in the embodiment of FIGS. 1 to 3 are achieved.

Moreover, in this embodiment, loosening of the nuts 88 ensures the free movement of the first side plates 75, second side plates 76, upper supports 77, lower supports 78, supports 79, upper pulleys 80, lower pulleys 81 and pulleys 82 along the longitudinal direction of the driving shafts 45 by virtue of the installation of the regulating means G, so that the lateral spacings of the upper traveling belts 83 and the lower traveling belts 84 can be regulated.

That is, the upper traveling belts 83 and the lower traveling belts 84 may be made close to reduce the lateral spacings thereof, for example, from the full line positions to the two-dot chain line positions as shown in FIGS. 6 and 7, or may contrarily be made remote to enlarge the lateral spacings thereof. Upon completion of this regulation of the lateral spacings, the nuts 88 may be turned to thereby finalize (fix) the positions of the upper traveling belts 83 and the lower traveling belts 84. Thus, in this embodiment, the tag 2 can be held at the most suitable positions in conformity with the size of the tag 2, so that the tag attachability can be markedly improved.

Naturally, the driving pulleys 71 are moved along the axes of the paired driving shafts 45 in accordance with the regulation of the lateral spacings of the upper traveling belts 83 and lower traveling belts 84 and fixed after their spacings have been brought into agreement with the lateral spacings of the upper traveling belts 83 and lower traveling belts 84. In this connection, if graduations are provided on the upper surfaces of the guide plates 85, it is feasible to uniformize the extents of movement of the studs 87, so that the lateral spacings of the upper traveling belts 83 and the lower traveling belts 84 can be regulated more accurately.

The same effect as in this embodiment can be attained by providing the sloped frames 41 with an actuator such as a cylinder (not shown) operated by oil or air pressure or a solenoid (now shown) as regulating means and operating the actuator to thereby effect the movement and stopping of the first side plates 75 and second side plates 76.

EFFECT OF THE INVENTION

The above constitution of the present invention is effective in carrying the tag in the state of having its side edges held between respective pairs of the upper and lower traveling belts respectively disposed right and left so that the tag is caused to gradually descend in accordance with the carriage thereof, this descent causing the head portion of the article to be gradually inserted in the aperture of the tag to the extent that the tag is forcibly guided to the vicinity of the shoulder portion of the article. Even if the head portion of the article is flanged, the descent forces the aperture to enlarge by means of the slits, so that the flange passes through the aperture. Thus, the tag can automatically and securely be fitted at the neck portion of the article (attached to the neck) in a manner such that it does not readily fall out.

Moreover, the tag carrying means may be provided with regulating means capable of regulating the lateral spacings of the paired traveling belts. In this construction, a holding force conforming with the size of the tag can be exerted by virtue of the capability of regulating the lateral spacings of the paired traveling belts, so that the tag attachability can be markedly improved.

What is claimed is:

1. An apparatus capable of attaching a tag at a neck portion of an article, which comprises:

an article-carrying means for carrying an article having a head portion and a neck portion in a predetermined direction;

a tag-supplying means for supplying a tag having an aperture adapted for inserting thereinto said head portion of the article; and a tag-carrying means disposed beyond the article-carrying means along the carrying direction of the article, comprising two paired upper and lower traveling belts, said pairs of upper and lower belts being laterally disposed respectively right and left of the tag and inclined so that each of said belts has a starting portion higher than the article and an ending portion of approximately the same height as a shoulder of the article, said tag-carrying means adapted for carrying the tag synchronously with the carried article while holding the side edges of the tag between said upper and lower traveling belts to thereby insert the head portion of the article into the aperture and attach the tag at the neck portion of the article.

2. The apparatus as claimed in claim 1, wherein said tag supplying means comprises:

a strip-supplying means for continuously supplying a strip which has a support surface supporting the tag;

a take-up means for taking up the strip having been supplied; and a peel plate disposed between said strip supplying means and said take up means, and adapted for sharply folding back the strip with a front edge portion thereof in such a manner that the tag separates from the support surface.

3. The apparatus as claimed in claim 1, wherein said tag-carrying means is provided with regulating means capable of regulating the lateral spacings of said paired traveling belts.

4. A method for attaching a tag at a neck portion of an article, comprises:

carrying an article having a head portion and a neck portion in a predetermined direction; and carrying a tag having an aperture adapted for inserting thereinto the head portion of the article by two paired upper and lower traveling belts while holding the side edges of the tag between the paired upper and lower belts, said paired upper and lower belts moving synchronously with the carried article so the center of the aperture coincides with the center of the head portion of the article, and being inclined so that each of them has a starting portion higher than the article and an ending portion of approximately the same height as a shoulder of the article to thereby guide the tag from a position beyond the article to the vicinity of the shoulder portion of the article while inserting the head portion of the article into the aperture of the tag.

5. The method as claimed in claim 4, wherein said tag is supplied to said pairs of the upper and lower belts by continuously carrying a strip having a supporting surface on which the tag is supported; and sharply folding back the strip in such a manner that the tag separates from the supporting surface.

* * * * *

UNITED STATES PATENT AND TRADEMARK OFFICE

CERTIFICATE OF CORRECTION

PATENT NO. : 5,637,182

DATED : June 10, 1997

INVENTOR(S) : Tetsuro Kimura and Hideyuki Maezawa

It is certified that error appears in the above-indentified patent and that said Letters Patent is hereby corrected as shown below:

Column 1 Line 26 "separate" should read --separates--.

Column 1 Line 55 "flang" should read --flange--.

Column 1 Line 60 "suffers from" should read --may have--.

Column 2 Line 16 "carrying the" should read --the carrying--.

Column 2 Line 38 "separate" should read --separates--.

Column 2 Line 66 "surface supporting" should read --supporting surface--.

Column 2 Line 67 "which on the" should read --on which the--.

Column 3 Line 18 "folding" should read --holding--.

Column 4 Line 13 "pealed" should read --peeled--.

Column 4 Line 15 after "arranged", second occurrence, delete --10--.

Column 5 Line 3 "carrying the" should read --the carrying--.

Column 5 Line 17 "45" should read --45, 45--.

Signed and Sealed this

Second Day of September, 1997

*Attest:*

*Attesting Officer*

Bruce Lehman

BRUCE LEHMAN

*Commissioner of Patents and Trademarks*